United States Patent [19]

Tada

[11] 4,278,556

[45] Jul. 14, 1981

[54] PROCESS FOR PRODUCING FLEXIBLE MAGNETS

[75] Inventor: Takeo Tada, Urawa, Japan

[73] Assignee: TDK Electronics Co., Ltd., Tokyo, Japan

[21] Appl. No.: 40,148

[22] Filed: May 17, 1979

[30] Foreign Application Priority Data

May 19, 1978 [JP] Japan ..... 53-058877

[51] Int. Cl.[3] ..... H01F 1/117

[52] U.S. Cl. ..... 252/62.54; 252/62.53; 252/62.63

[58] Field of Search ..... 252/62.53, 62.54, 62.63; 423/594

[56] References Cited

U.S. PATENT DOCUMENTS

| | | | |
|---|---|---|---|
| 2,762,778 | 9/1956 | Gorter et al. | 252/62.63 X |
| 2,854,412 | 9/1958 | Brockman et al. | 252/62.63 X |
| 3,043,776 | 7/1962 | Jonker | 252/62.63 X |
| 3,576,745 | 4/1971 | Tokar | 252/62.63 X |

*Primary Examiner*—Jack Cooper

*Attorney, Agent, or Firm*—Wyatt, Gerber, Shoup, Scobey & Badie

[57] ABSTRACT

Procedure for pulverizing ferrite particles for use in the production of flexible magnets utilizing alcohols containing up to 4 carbon atoms and having a boiling point up to 100° C. as a pulverization promoter, annealing at an elevated temperature, and dispersing in a flexible, nonmagnetic matrix.

3 Claims, No Drawings

PROCESS FOR PRODUCING FLEXIBLE MAGNETS

FIELD OF THE INVENTION

This invention relates to the production of hard ferrite powder for use in the manufacture of flexible permanent magnets containing such ferrite powder in a nonmagnetic plastic matrix of flexible plastic material.

BACKGROUND OF THE INVENTION

Ferrite powders, such as can be prepared, for example from barium, strontium or other metallic ferrites have been shaped and sintered to form many useful materials. Amongst the most useful of these materials are flexible permanent magnets which have been manufactured by dispersing ferrite particles or powders in a flexible plastic matrix.

It has been observed that for optimum utility, the particle size of the ferrite mixed in the plastic should be such that particle size is close to that of a single magnetic domain. In the case of powders of barium, strontium and similar ferrites the magnetic domain is approximately 1$\mu$. Therefore the best products are prepared from powders in which the average particle diameter is about 1$\mu$. Some variation is acceptable however, so that for particular applications the range of average particle size may be from about 1$\mu$ to 1.75$\mu$.

If the average particle diameter is appreciably below this value, kneading becomes more and more difficult in the usual equipment with the result that the dispersion of the ferrite in the plastic is poor, and it is difficult to prepare products containing optimum amount of magnetic material. As the average particle diameter increases above 1$\mu$, and expecially as it increases appreciably above 1.5$\mu$, the particles exceed a single magnetic domain and become multi-domain. This results in a reduction of both magnetic retentivity and energy product.

Magnetic retentivity or coercive force (H) is the magnetizing force that must be applied to a magnetic material in a direction opposite the residual induction in order to reduce the induction to zero. It is expressed in oersteds. For best products the value should be at least 2450 as $_I H_C$.

Energy product is the product of the magnetic induction B and magnetic retentivity expressed in gauss oersteds.

For flexible permanent magnets these values should be as high as possible. Magnets produced in accordance with the process of this invention, in addition to their other improved magnetic properties manifest a magnetic retentivity of at least 2450 oersteds.

It has proved difficult to pulverize ferrite particles to the desired average particle diameter for the production of optimized flexible magnets. Two procedures are presently employed, the dry method and the wet method. In the dry method the particles are pulverized without any added lubricant. A disadvantage of the dry method is that excessively long periods of time are required to produce particles of the desired size. The increased time adds to the cost of the operation. The problem has been attributed to the fact that certain amounts of ferrite powder as it forms, adheres to the internal surfaces or the crushing media of the machines, and dampens the crushing impact needed for pulverizing action.

In the wet method, pulverization promoters such as higher fatty acids and higher alcohols are employed. Stearic acid is especially popular. A difficulty with the method is that it is difficult to achieve the desired particle size. It is however, the preferred of the two methods.

Hard ferrite powder produced by pulverizing barium, strontium or similar ferrites generally manifest poor magnetic properties due to various mechanical stresses and distortions which develop in the powder during crushing. These are conventionally corrected by annealing at high temperature. The resulting annealed products are normally well adapted for use in flexible rubber or plastic magnets.

It has been observed that during the annealing process process powders produced using stearic or other higher fatty acid tend to sinter and adhere together during annealing. As a result the ferrite particles produced are larger than the desired magnetic domain size. As a result optimum magnetic characteristics are not developed in the particles themselves, or in flexible magnets employing them. A particular difficulty with the larger particles formed from sintered and fused grains is that they are not amenable to magnetic orientation such as is utilized in the manufacture of flexible magnets of the anisotropic type.

THE INVENTION

A method for the production of hard ferrite powder suitable for use in the production of flexible ferrite particle magnets in which the magnets are blended with a workable non-magnetic material, formed into sheets and, if desired, cured and magnetized.

In accordance with the process of this invention hard ferrite powder of improved magnetic characteristics with an average particle size of from 1 to 1.75$\mu$ are produced by pulverizing coarse ferrite grains in the presence of from 0.1 to 10% by weight, based on the weight of the ferrite powder of an alcohol having a boiling point up to 100° C. under standard conditions and thereafter annealing the crushed powder by heat treating.

The preferred pulverization promoters are monohydroxy alkols containing up to three carbon atoms. Secondary and tertiary butanol may be employed, but they are not as convenient as the lower alkanols.

A particular advantage of the process of this invention is that the ferrite grains do not sinter and fuse together during the annealing process.

The process of the invention has the advantages of the dry process without the attendant disadvantages. Ferrite particles of magnetic domain size can be obtained. Since the particles do not fuse together, they are readily oriented in a workable matrix. Initially, they may be oriented in positions parallel to each other by the application of mechanical shearing force, as by rolling. If desired they may also be anisotropically oriented by the application of a suitable magnetic force in the selected direction. The resulting permanent magnets have remarkably excellent magnetic characteristics as will be apparent from the examples.

Another advantage of the process of the invention is that the pulverization promoter evaporates due to the frictional heat developed in the crushing mill. Thus no extra drying step is required as in the conventional wet method.

The preferred alcohols are mono-hydroxy such as methanol, ethanol, propanol, isopropanol and mixtures of these such as fuel oil and ethanol denatured with methanol. Polyhydroxy alcohols and alcohols containing more than four carbon atoms are not suitable for use in this invention since they tend to promote fusion of the particles during annealing.

The quantity of pulverization promoter to be employed in the process of this invention varies somewhat with the selected alcohol. Generally, from about 0.1% to 10% by weight based on the weight of ferrite is suitable, although some variation from this range may be employed without unacceptable adverse effect. The general limitation at the lower end of the range is the magnetic properties which are acceptable. At the upper end of the range, it has been observed that as the amount increases significantly above 10%, progressively larger amounts of alcohol remain in the product until, finally, an additional drying step is required as in the wet process.

After pulverization to the desired degree, the particles are annealed at an elevated temperature. The selected temperature should be high enough to relax the stresses and crystalline distortion and yet not so high as to fuse the grains. Normally the selected temperature will be from about 900° C. to 1000° C.

Flexible magnets may be produced from the products of this invention by blending the ferrite powder with the selected rubber or plastic. The matrix will normally include vulcanizing or curing agents which will be activated, usually by heating, after the powder and matrix have been thoroughly blended for example by mixing in a Banbury mixer and rolling.

Other conventional additives may also be employed in the production of the permanent magnets.

The following non-limiting examples are given by way of illustration only.

EXAMPLE 1

A mixture of $BaCO_3$ and $Fe_2O_3$ in the proportion of 1 mole of BaO to 5.6 moles of $Fe_2O_3$ was placed in an attrition mill and stirred and mixed by the wet method into a slurry, which was then dried into a cake. The cake was heated in an electric furnace at a heating rate of 300° C. per hour to 1300° C. This temperature was maintained for 3 hours to sinter the cake. The sintered crystalline cake was pulverized in a rod mill to form coarse grains about 20μ in diameter.

The coarse grain powder was tested with various pulverization promoters in a vibratory mill. The fine powders produced were measured for magnetic retentivity (*I*Hc), average grain diameter (by Fisher subsieve sizer) and press density (g/cm$^3$). This last mentioned value is a measure of ease with which the powder can be filled into a plastic or rubber material. For best results, it should be more than 3.30. The measured values are indicated in the attached table for each pulverization promoter which also shows the amount of promoter employed. To achieve pulverization, chrome-steel balls 12 mm in diameter were used as the pulverizing medium in the ratio of 10 weight parts of steel balls to 1 weight part of powder. Crushing was continued for 6 hours to obtain a grain size of about 1μ. This finely crushed powder was annealed in a rotary kiln at 950° C. to relax and remove the pulverization-induced grain distortion. The values of retentivity (*I*Hc), average grain diameter and press density (g/cm$^3$) of the annealed powders, are also listed in the table 1.

TABLE 1

| | | Properties of Powder after Pulverization | | | Properties of Powder after Annealing | | |
|---|---|---|---|---|---|---|---|
| Kind of alcohol | Amount added (wt %) | $I^Hc$ (oe) | Press density (g/cm$^3$) | Average grain diameter (μ) | $I^Hc$ (oe) | Press density (g/cm$^3$) | Average grain diameter (μ) |
| Methanol-denatured alcohol | 0.01 | 950 | 3.39 | 2.05 | 1980 | 3.38 | 2.10 |
| | 0.08 | 1090 | 3.39 | 1.32 | 2570 | 3.40 | 1.50 |
| | 0.10 | 1180 | 3.41 | 1.27 | 2610 | 3.41 | 1.48 |
| | 1.00 | 1130 | 3.48 | 1.01 | 2740 | 3.45 | 1.28 |
| | 5.00 | 1190 | 3.46 | 1.05 | 2780 | 3.43 | 1.25 |
| | 10.0 | 1280 | 3.40 | 1.20 | 2540 | 3.40 | 1.49 |
| | 11.0 | 1210 | 3.39 | 1.27 | 2510 | 3.40 | 1.51 |
| | 15.0 | 1190 | 3.35 | 1.35 | 2420 | 3.38 | 1.72 |
| Ethanol | 0.01 | 870 | 3.35 | 2.52 | 1450 | 3.39 | 2.62 |
| | 0.08 | 1020 | 3.38 | 1.35 | 2440 | 3.40 | 1.65 |
| | 0.10 | 1260 | 3.43 | 1.32 | 2480 | 3.45 | 1.62 |
| | 1.00 | 1150 | 3.49 | 0.96 | 2730 | 3.43 | 1.23 |
| | 5.00 | 1260 | 3.49 | 0.98 | 2760 | 3.45 | 1.21 |
| | 10.0 | 1310 | 3.47 | 1.21 | 2490 | 3.46 | 1.75 |
| | 11.0 | 1210 | 3.42 | 1.27 | 2450 | 3.40 | 1.75 |
| | 15.0 | 1050 | 3.33 | 1.32 | 2390 | 3.37 | 1.80 |
| Ethylen glycol | 0.01 | 900 | 3.38 | 2.31 | 1980 | 3.39 | 2.32 |
| | 0.08 | 1110 | 3.40 | 1.20 | 2010 | 3.31 | 1.89 |
| | 0.10 | 1090 | 3.44 | 1.02 | 2020 | 3.25 | 2.02 |
| | 1.00 | 1090 | 3.43 | 0.95 | 1940 | 3.21 | 2.51 |
| | 5.00 | 1140 | 3.43 | 0.96 | 1770 | 3.19 | 2.55 |
| | 10.0 | 1110 | 3.40 | 1.00 | 1470 | 3.15 | 2.68 |
| | 11.0 | 1090 | 3.42 | 1.05 | 1420 | 3.17 | 2.76 |
| | 15.0 | 1140 | 3.39 | 1.12 | 1310 | 3.09 | 2.85 |

Effect of Alcohol Additives on Properties of Ferrite Magnetic Powder

| | | Properties of Powder after Pulverization | | | Properties of Powder after Annealing | | | |
|---|---|---|---|---|---|---|---|---|
| Kind of alcohol | Amount added | $I^{Hc(oe)}$ | Press density | Average grain diameter | $I^{Hc(oe)}$ | Press density | Average grain diameter | Remarks |
| Methanol | 1 | 1140 | 3.50 | 0.95 | 2750 | 3.44 | 1.25 | |
| Ethanol | 1 | 1150 | 3.49 | 0.96 | 2730 | 3.43 | 1.23 | |
| Methanol-denatured | | | | | | | | |

TABLE 1-continued

| | | | | | | | | |
|---|---|---|---|---|---|---|---|---|
| Ethanol | 1 | 1130 | 3.48 | 1.01 | 2740 | 3.45 | 1.28 | |
| Isopropanol | 1 | 1200 | 3.46 | 1.02 | 2680 | 3.40 | 1.32 | |
| n-butanol | 1 | 1170 | 3.47 | 0.93 | 2420 | 3.29 | 1.51 | |
| n-pentanol | 1 | 1110 | 3.46 | 0.98 | 2380 | 3.29 | 1.63 | |
| Ethylene glycol | 1 | 1090 | 3.43 | 0.95 | 1940 | 3.21 | 2.51 | |
| Glycerine | 1 | 1150 | 3.47 | 0.98 | 1800 | 3.21 | 2.56 | |
| Ethanol | 0.1 | 1260 | 3.43 | 1.32 | 2480 | 3.45 | 1.62 | Powder sticking to mill and balls. |
| Ethanol Methanol-denatured | 10 | 1310 | 3.47 | 1.21 | 2490 | 3.46 | 1.75 | Wet and sticky |
| Ethanol Methanol-denatured | 0.2 | 1210 | 3.42 | 1.04 | 2650 | 3.41 | 1.48 | |
| Ethanol | 8 | 1290 | 3.48 | 1.10 | 2580 | 3.47 | 1.46 | |

TABLE 2

| | Press density ($g/cm^3$) | Average grain diameter ($\mu$) | Br (G) | $B^Hc$ (oe) | $I^HC$ (oe) | $(BH)_{max}$ (G. oe) |
|---|---|---|---|---|---|---|
| Example 2 | 3.40 | 1.24 | 2800 | 2220 | 2700 | $1.9 \times 10^6$ |
| Example 3 | 3.19 | 2.40 | — | — | — | — |
| Example 4 | 3.40 | 1.24 | 3040 | 2450 | 2700 | $2.3 \times 10^6$ |
| Example 5 | 3.34 | 1.12 | 2750 | 2680 | 3250 | $1.8 \times 10^6$ |

It will be noted in the attached table that:

(1) The alcohols are effective pulverization promoters in that they enable the ferrite powder to be easily pulverized to magnetic domain size.

(2) With the alcohols used as promoters, the properties of the ferrite powder produced by the process including the annealing operation vary markedly with the kind of alcohol used.

Specifically, methanol, ethanol, methanol-denatured ethanol, isopropanol and the like, all having a carbon number of 1 to 3, improve magnetic characteristics greatly in the powder that has been annealed, without any appreciable lowering of press density, the average grain size being smaller. The products produced have properties suitable for the production of rubber and plastic magnets. In contrast to these alcohols, n-butanol and n-pentanol, which contain at least four carbon atoms and boil above 100° C., cause deterioration of the magnetic characteristics when they are used as promoters. The lowered press density and increased grain diameters observed suggest that, during annealing, the ferrite grains fuse together to produce inferior products.

Ethylene glycol and glycerine, which are divalent and trivalent alcohols, respectively, are satisfactory as far as their effect on pulverization is concerned, but behave like binders during the process of annealing and considerably increase the average grain diameter. It will be seen that the retentavity ($_I$Hc) and press density due to these multi-valent promoters are both markedly inferior.

(3) When ethanol was added in an amount of 0.1%, the tendency of powder being pulverized to adhere to the wall surface of the ball mill and to the balls, thereby impeding the progress of pulverizing action, was noted. With ethanol added in an amount of 10%, pulverizing action was observed to progress fairly well but, because the powder became somewhat sticky, it was difficult to transport the powder to the subsequent stage.

EXAMPLE 2

Barium carbonate ($BaCO_3$) and ferric oxide ($Fe_2O_3$) in the proportion of 1 mole of BaO to 5.8 moles of $Fe_2O_3$ were treated as in Example 1 to produce a coarse powder.

Next, the coarse powder was finely pulverized in a vibrating mill. Steel balls having a 12 mm diameter were used as pulverizing media and the weight ratio of coarsely crushed grains to steel balls was 1 to 10 by weight. Methanol denatured ethanol, 1 part, based on 100 parts by weight of coarsely pulverized grains, was used as a pulverization assistant. The pulverization period was 6 hours.

The resulting fine grains were dispersed by an impact pulverizer and annealed at 950° C. for 3 hours in an electric furnace.

Average grain size of the fine grains was measured by Fisher Sub-Sieve Seizer Model 95.

Fifteen grams of the powder were pressed at a pressure of 1 ton/$cm^2$ into the size of 25 mm in diameter, and the compressed density was measured.

Then, 148 g of nylon-6, 12 g of stearic acid and 1,840 g of the ferrite powder were blended at 300° C. After cooling the blend, the blend was pulverized into particles about 3 mm in diameter.

Thereafter, the resulting material was molded to grains having 25 mm diameter and 10 mm thickness in a metal mold at 280° C. During heating 6,000 oersteds of direct current magnetic field imposed in the direction of the 10 mm thickness. After cooling the metal mold, the molded article was taken out of the metal mold.

Magnetic property of the molded article was measured in the direction of 10 mm thickness.

The results are shown in Table 2.

EXAMPLE 3

The same process as in Example 2 was carried out to prepare fine powder, except that n-octanol was used as the pulverization assistant in place of denatured ethanol. The average grain size and the compressed density were measured by the same method employed in Example 2. The blending process was attempted in the same manner as in Example 2, but suitable products could not be produced.

EXAMPLE 4

One hundred and forty grams of the finely pulverized grains of Example 2, 16 g of thermoplastic polyamide resin and 4.0 g of mixed ortho- and para-toluene ethylene sulfonamide plasticizer were mixed on a heated mill roll and passed through the roll several times with cooling to finally prepare a sheet 1.6 mm thick. The sheet was heated at 250° C., cooled in a magnetic field of 22 kilogauss, and cured. The magnetic properties of the sheet in the thickness direction were measured. The test results were shown in Table 2.

EXAMPLE 5

A mixture of strontium carbonate ($SrCO_3$) and ferric oxide ($Fe_2O_3$) in the proportion of 1 mole of $SrCO_3$ to 5.6 moles of $Fe_2O_3$ was subjected to wet mixing in an attrition mill. The resulting slurry mixture was dried and then heated in an electric furnace at the rate of 300° C. per hour to 1200° C. and this temperature was maintained for 3 hours to sinter the cake. The thus sintered cake was pulverized coarsely in a pulverizer to particles about 20μ in diameter. Next, the coarse grain powder was finely pulverized by a vibratory mill using steel balls 12 mm in diameter. The ratio of coarse grain powder to steel balls was 1 to 10 by weight. One part, based on 100 parts by weight of coarse-grain powder, of ethyl alcohol was added as a pulverizing assistant. The vibratory mill was operated for 6 hours.

The resulting finely pulverized grains were dispersed using an impact pulverizer and annealed in an electric furnace at 930° C. for 3 hours. The average grain size was measured by Fisher Sub-Sieve Seizer Model 95. Fifteen grams of fine grains were pressed under a pressure of 1 ton/cm$^2$ into particles having a diameter of 25 mm, and the compact density measured.

Then, the fine grains were blended with nylon in the same manner as in Example 2, heated and melted in a magnetic field, cooled and molded.

The magnetic properties of the obtained mold were measured by the same procedures as that employed in Example 2. The results are reported in Table 2.

What is claimed is:

1. A method for producing flexible magnets comprising hard ferrite particles with an average particle size of from 1 to 1.75μ dispersed in a flexible non-magnetic matrix which comprises pulverizing hard ferrite particles have a particle size greater than 1.75μ in the presence of from 0.1% to 10%, based on the weight of ferrite particles, of at least 1 alkanol having a boiling point up to 100° C. and containing up to 4 carbon atoms, annealing the resulting particles at a temperature of from about 900° C. to 1000° C. to relax stresses and crystalline distortion therein; the annealed particles being nonfused and dispersing the annealed particles in a flexible non-magnetic matrix.

2. A method according to claim 1, wherein the alkanol is a monovalent alkanol containing up to three carbon atoms.

3. A method according to claim 1, wherein the alkanol is selected from the group consisting of ethanol and ethanol mixed with methanol.

* * * * *